US008733266B2

(12) United States Patent
Xie et al.

(10) Patent No.: US 8,733,266 B2
(45) Date of Patent: May 27, 2014

(54) INTEGRATIVE DEEP DRAFT FLOATING PRODUCTION PLATFORM WITH UNCONDITIONAL STABILITY AND OFFSHORE INSTALLATION METHOD THEREOF

(75) Inventors: Bin Xie, Beijing (CN); Wenhui Xie, Beijing (CN); Hengyi Zeng, Beijing (CN); Wei Zhang, Beijing (CN); Junrong Wang, Beijing (CN); Zhe Jiang, Beijing (CN)

(73) Assignees: China National Offshore Oil Corporation, Beijing (CN); China National Offshore Oil Corporation Research Institute, Beijing (CN)

( * ) Notice: Subject to any disclaimer, the term of this patent is extended or adjusted under 35 U.S.C. 154(b) by 0 days.

(21) Appl. No.: 13/702,302

(22) PCT Filed: Dec. 2, 2010

(86) PCT No.: PCT/CN2010/001948

§ 371 (c)(1),
(2), (4) Date: Dec. 5, 2012

(87) PCT Pub. No.: WO2011/153677

PCT Pub. Date: Dec. 15, 2011

(65) Prior Publication Data

US 2013/0092069 A1 Apr. 18, 2013

(30) Foreign Application Priority Data

Jun. 9, 2010 (CN) ..... 2010 1 0199308

(51) Int. Cl.
*B63B 35/44* (2006.01)

(52) U.S. Cl.
USPC ..... 114/265

(58) Field of Classification Search
USPC ..... 114/264–266
See application file for complete search history.

(56) References Cited

U.S. PATENT DOCUMENTS 4,864,958 A * 9/1989 Belinsky ..... 114/265
4,983,073 A * 1/1991 Petty et al. ..... 405/224

(Continued)

FOREIGN PATENT DOCUMENTS

CN 2772957 Y 4/2006
CN 2839108 Y 11/2006

(Continued)

OTHER PUBLICATIONS

ISA China, International Search Report of PCT/CN2010/001948, Mar. 17, 2011, WIPO, 6 pages.

*Primary Examiner* — Stephen Avila
(74) *Attorney, Agent, or Firm* — Alleman Hall McCoy Russell & Tuttle LLP

(57) ABSTRACT

An integrative deep draft floating production platform with unconditional stability and an offshore installation method thereof are disclosed. The platform comprises an ring ballast tank at the bottom, some columns with small cross sections, an ring buoyancy tank at the middle part, some columns with large cross sections, and an upper drilling equipment and oil gas processing module. The ballast tank adopts a permanently fixed ballast, and the tank is internally filled with weights to ensure that the center of buoyancy of the platform is higher than the center of gravity. The drilling equipment and oil gas processing module is installed in the construction site, and the platform is transported to the installation site by a dry tow or wet tow as a whole and then is installed. The platform can be applied to deepwater oil and gas exploitation under harsh marine environment.

12 Claims, 7 Drawing Sheets

(56) References Cited

U.S. PATENT DOCUMENTS

| | | | | |
|---|---|---|---|---|
| 6,024,040 | A * | 2/2000 | Thomas | 114/264 |
| 6,652,192 | B1 * | 11/2003 | Xu et al. | 405/195.1 |
| 6,718,901 | B1 * | 4/2004 | Abbott et al. | 114/264 |
| 6,761,124 | B1 * | 7/2004 | Srinivasan | 114/264 |
| 6,899,492 | B1 * | 5/2005 | Srinivasan | 405/205 |
| 7,963,241 | B2 * | 6/2011 | Srinivasan | 114/267 |
| 2005/0120935 | A1 * | 6/2005 | Wybro et al. | 114/265 |
| 2005/0160958 | A1 * | 7/2005 | Kryska et al. | 114/125 |
| 2006/0204340 | A1 * | 9/2006 | Leenaars | 405/223.1 |
| 2008/0264322 | A1 * | 10/2008 | Horton et al. | 114/266 |
| 2009/0205554 | A1 * | 8/2009 | Srinivasan | 114/264 |
| 2010/0024705 | A1 * | 2/2010 | Leverette | 114/264 |

FOREIGN PATENT DOCUMENTS

| | | | |
|---|---|---|---|
| CN | 101475049 | A | 7/2009 |
| CN | 201343129 | Y | 11/2009 |
| CN | 101857072 | A | 10/2010 |
| WO | 9623690 | A1 | 8/1996 |
| WO | 9957010 | A1 | 4/1999 |

* cited by examiner

INTEGRATIVE DEEP DRAFT FLOATING PRODUCTION PLATFORM WITH UNCONDITIONAL STABILITY AND OFFSHORE INSTALLATION METHOD THEREOF

CROSS-REFERENCE TO RELATED APPLICATIONS

The present application is the U.S. National Phase of International PCT Application Serial No. PCT/CN2010/001948, filed Dec. 2, 2010, which claims priority to Chinese Application No. 201010199308.5, filed Jun. 9, 2010, the disclosure of each of which are hereby incorporated by reference in their entirety for all purposes.

TECHNICAL FIELD

The present invention relates to the deep draft floating production platform and offshore installation method thereof, and in particular, to the integrative deep draft floating production platform with unconditional stability and the offshore installation method thereof, which is used in the deepwater oil and gas exploitation. Wherein two transport ways can be achieved, including a barge dry tow as a whole and wet tow, the installation does not need a large floating crane, and dry tree can be used.

BACKGROUND

As the offshore oil and gas exploitation advanced into the deepwater application, the traditional fixed production platform cannot meet the requirements of the deepwater oil and gas exploitation, and the floating production platform becomes currently the main equipment of the deepwater oil and gas exploitation. Recently, a variety of floating production platforms used in the deepwater oil and gas exploitation have been developed and applied into the deepwater oil and gas exploitation over the world, such as the semi-submersible platform, the deep draft spar platform, and the tension leg platform. Each of the above platforms has its own advantages and disadvantages: the semi-submersible platform has poor heaving motion performance, and when used as the deepwater oil and gas production platform, it has to be used with wet tree which is technically complex and costly; the deep draft spar platform has good motion performance and can employ the dry tree, however, it's disadvantages comprise: the topside and the lower hull thereof requiring separate offshore installation, the complexity of installation and connection offshore, the small area of the upper deck, difficulty of design, and difficulty of arrangement of the oil and gas processing facilities; and the tension leg platform also has good motion performance, however, since it connects to a seabed infrastructure via a tension leg, the cost would increase as the increase of water depth.

For such advantages and disadvantages of the platforms, many novelty technical solutions and new concepts have been proposed in the offshore engineering, however, such new concepts and the traditional platforms are installed complexly offshore and need to use large ocean engineering equipments for offshore installation, causing high cost.

SUMMARY OF INVENTION

To solve above problems, the present invention provides an integrative deep draft floating production platform with unconditional stability and the offshore installation method thereof, which has excellent motion performance, large area of the deck, and high integration of construction, wherein two transport ways can be achieved, including a barge dry tow and self-floating wet tow, the offshore installation does not need a large floating crane, and which be applied in different exploitation modes, such as the dry tree, the wet tree, and their combination, and whose cost is not sensitive to the increase of the water depth.

Such object is achieved by the following technical solution of the present invention: an integrative deep draft floating production platform with unconditional stability, characterized in that: it includes an ring ballast tank at the bottom, some small-cross-section columns on the ring ballast tank, a middle ring buoyancy tank with the same or similar shape as the ring ballast tank, some large-cross-section columns with the same number as the small-cross-section columns and located on the ring buoyancy tank, and a drilling rig and oil gas processing module on the top of the large-cross-section columns; wherein the ring ballast tank fill permanently fixed ballast, and the tank is internally filled with weights to ensure that the center of buoyancy of the platform is higher than the center of gravity; the large-cross-section columns are uniformly arranged on the ring buoyancy tank and the lower parts thereof are integrated with the ring buoyancy tank; each large-cross-section column is provided with a central pore canal axially, wherein the lower part in the central pore canal is provided with a chopping board connection structure with a groove; corresponding to the large-cross-section columns, the small-cross-section columns are uniformly arranged on the ring ballast tank and the lower parts thereof are integrated with the ring ballast tank: after the construction of the platform is completed, the small-cross-section columns are inserted into and pass through the central pore canals of the large-cross-section columns correspondingly, and the small-cross-section columns are integrated with the large-cross-section columns via wedges, bolts, or pins while the platform is in a folded state: each small-cross-section columns is provided with a reverse-cone structure on the top; each large-cross-section columns is provided with a group of mooring line which are connected to anchor on the seabed via a traditional anchoring means; and the drilling rig and oil gas processing module is installed at a construction site, and the platform is transported to the installation site by a dry tow or wet tow as a whole, and then may be unfolded and installed.

The ring ballast tank is a regular polygon structure with a heave plate integrated with it in the center at the bottom, wherein the heave plate has openings in the center through the oil and gas production riser/drilling riser connecting the oil gas processing module/the drilling rig.

The ring buoyancy tank has a large box-shaped structure with the corners rounded, and two longitudinal bulkheads are provided in the ring buoyancy tank to divide the inner space of the buoyancy tank structure into three parts, wherein a walkway is provided in the space between said two longitudinal bulkheads, and the space outside said longitudinal bulkheads is divided into several watertight compartments.

Said large-cross-section columns are cylinder, square column, prism or cylinder-like case structures, and each of said large-cross-section columns is provided with helical strakes on their outside.

Said mooring lines are traditional steel chains, a combination of anchor chain-wire rope-anchor chain, or Nylon rope.

The offshore installation method of above integrative deep draft floating production platform with unconditional stability includes the steps below: 1) transporting the platform to the installation site via barge dry tow or via self-floating wet tow, offloading it at the installation site, with the platform in a free-floating mode; 2) ballasting the ring ballast tank such that the platform sinks as a whole; 3) when the weights of the ring ballast tank, ballasting water, and the small-cross-section columns are more than their buoyancy force, the ring ballast tank sinks, making the small-cross-section columns gradually going down within the large-cross-section columns in a controlled manner, wherein the ring ballast tank is suspended under the ring buoyancy tank via the reverse-cone structure on the top of the small-cross-section columns, and the whole platform floats in the water due to the buoyancy force provided by the ring buoyancy tank and the large-cross-section columns; 4) passing a hydraulic forging connection apparatus through the central pore canal to a connection between the large-cross-section column and the small-cross-section column by using a crane of the platform to enable the hydraulic forging, plastically deforming the outer panel of the small-cross-section column at the connection with the large-cross-section column by a hydraulic pressure and pressing it into the groove of the chopping board connection structure at the connection of the lower part of the large-cross-section column, to make these two structures be jointed into an integrated structure; and 5) after connecting the large-cross-section columns and the small-cross-section columns is completed, applying an ultrasonic inspection to check the installation quality of the connection, and if the inspection is passed, ballasting the ring ballast tank to a set value, and installing mooring line to complete all of the installation operations of the platform.

With above technical solutions, the present invention has following advantages:

1. The ballast tank of the present platform adopts a permanently fixed ballast mode with the iron ore or other weights filled therein to ensure that the buoyant center of the platform is higher than the center of gravity at any condition and that the platform has a deep draft in service, thereby achieving an unconditional stability of the platform in ocean and ensuring the stability and the seakeeping characteristic meeting operating requirements. Meanwhile, since the draft of the present invention is less than that of the traditional deep draft spar platform, the difficulties of the construction, transport, and installation of the platform are effectively reduced. Since the columns of the present platform are smaller in diameter than those of the traditional semi-submersible platform, the wave load applied to the platform is effectively reduced.

2. The present invention employs a foldable structure. The topside can be installed at the construction site, transported to the installation site in the folded configuration via the dry tow or self-floating wet tow. Without the use of any large floating crane, an installation convenience can be achieved in the ocean and the installation cost of the platform can be reduced.

3. The lower small-cross-section columns of the present platform are integrally connected with the ring ballast tank and the upper large-cross-section columns are integrally connected with the ring buoyancy tank, such that the ring buoyancy tank functions as the supporting structure of the whole platform and provide buoyancy force to the platform and makes the lower structure of the platform as a complete frame structure to improve the global strength of the platform, thereby resisting the environment load acting on the platform by transmitting the load from a single column to the global structure of the platform. Furthermore, the ring ballast tank and the ring buoyancy tank can effectively transmit the interacting forces among the columns due to the waves and the imbalance loading of the platform, thus the platform has good stiffness and strength of the global structure, the fatigue hot spot stress at the joints of the platform under environment load condition is effectively reduced, the fatigue life of the global structure of the platform is improved, and the adaptability of the platform to the harsh conditions of the ocean is improved.

4. The large-cross-section columns of the present invention are cylindrical, square column, prism or cylinder-like case structures, such that the wave drag force applied to the platform can be effectively reduced. Each of large-cross-section columns is provided with helical strakes on their outsides, such that the vortex induced motion of the platform is effectively avoided.

5. The ring ballast tank of the present invention has a heave plate integrated with it in the center at the bottom, such that the heave additional mass and heave damping of the platform effectively increase, the heave motion performance can be improved, and the surface tree can be disposed on the deck of the platform to enable the oil and gas exploitation via dry tree, thereby substantially reducing the cost of the exploitation operation. Meanwhile, according to the requirement of the oilfield development mode, the platform of the present invention can also suit a manner of the wet tree exploitation with the subsea wellhead and the riser tie back to the platform, or a manner of wet-dry tree combination exploitation wherein a dry tree exploitation or a wet tree exploitation can be used for various wells of the oil field.

6. The ring buoyancy tank of the present invention is a large box-shaped structure with the corners rounded to reduce the wave drag force. Two longitudinal bulkheads are provided in the ring buoyancy tank, so as to divide the inner space of the buoyancy tank structure into three parts to ensure the security of the platform. A walkway is provided in the space between said two longitudinal bulkheads such that the operator can access to the maintenance. The space outside said two longitudinal bulkheads is divided into several watertight compartments to function as fuel/fresh water compartment, equipment compartment, and ballast compartment.

7. The present invention is located via mooring system, whose cost is not sensitive to the increase of the water depth, and which can be applied in the deepwater and ultra-deepwater oil and gas field. When the platform needs to be moved to another place, the mooring lines are disassembled and the platform is transported to another place, such that the cost is reduced and the economic efficiency is improved.

8. The present invention employs a multi-column structure, and the area of the deck for the upper drilling rigs and oil gas processing module is increased, thereby enabling the optimization of the arrangement of the upper oil gas processing facilities and drilling rigs, improving the efficiency of the operation of the platform, and improving the safety of the arrangement of the upper facilities.

To sum up, the platform of the present invention has a good motion performance; unconditional stability; may accommodate a large range of operation water depths; has good strength as a global structure, and a lower construction cost; and can be applied to deepwater oil and gas exploitation under harsh marine environments.

PREFERRED EMBODIMENT OF THE INVENTION

The detailed description of the present invention is provided hereafter, in combination with the appended drawings and preferred embodiments.

Figure 1:
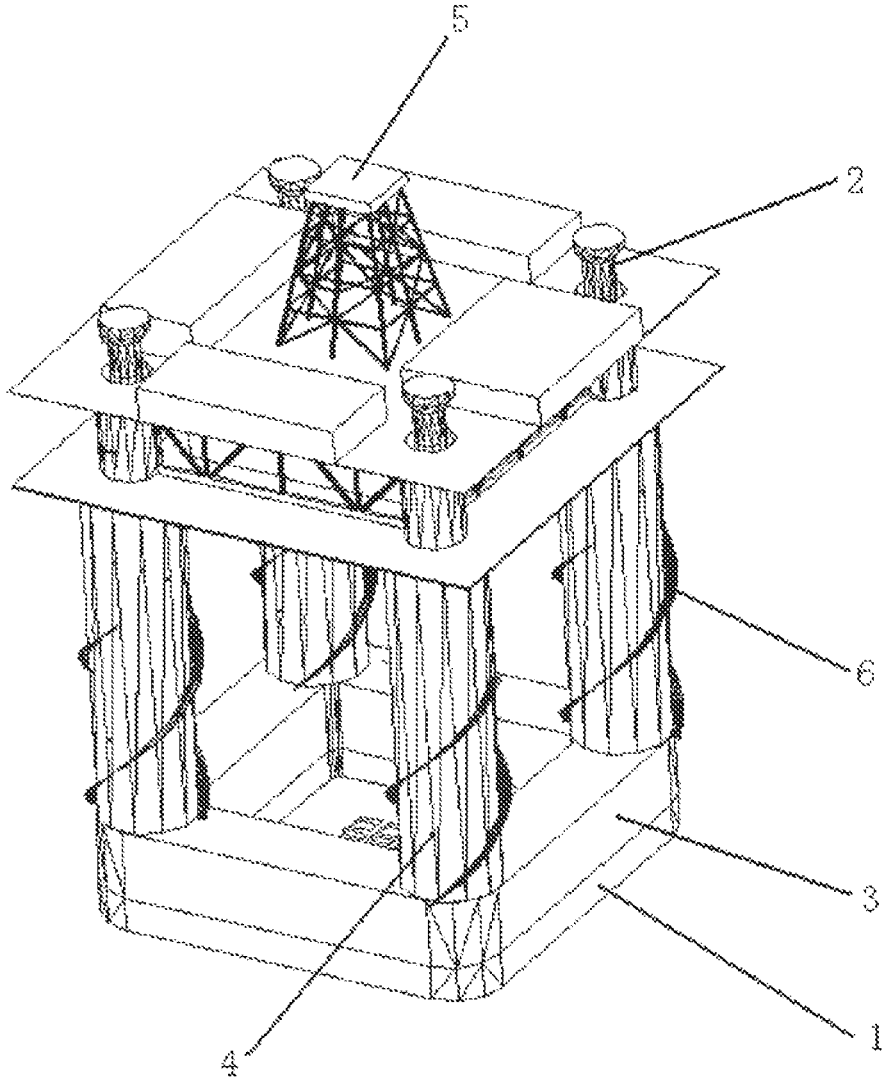
FIG. 1 is an illustration of the platform with four columns according to the present invention, showing in a folded state.

As shown in FIG. 1, the present platform comprises a ring ballast tank 1 at the bottom which has a square outer contour, four columns with small cross sections 2 (only for example but not limited to) on the ring ballast tank 1, a ring buoyancy tank 3 at the middle part which has the same or similar shape as that of the ring ballast tank 1, four columns with large cross sections 4 (only for example but not limited to) on the ring buoyancy tank 3, and an upper drilling rig and oil gas processing module 5 which is on the top of the large-cross-section columns 4.

Figure 2:
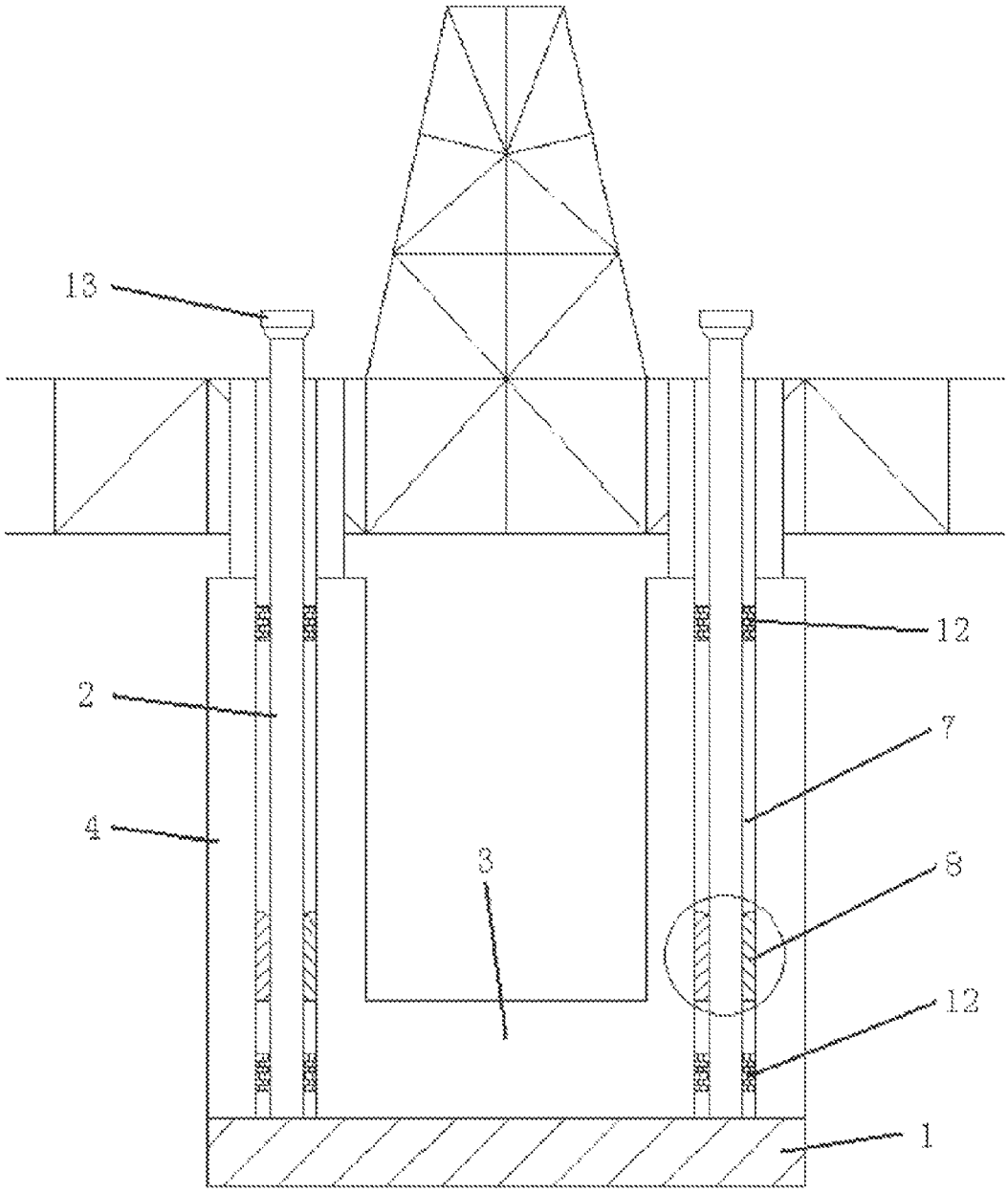
FIG. 2 is an illustration of the connection of columns of the platform with four columns according to the present invention, shown in a folded state.
Figure 3:
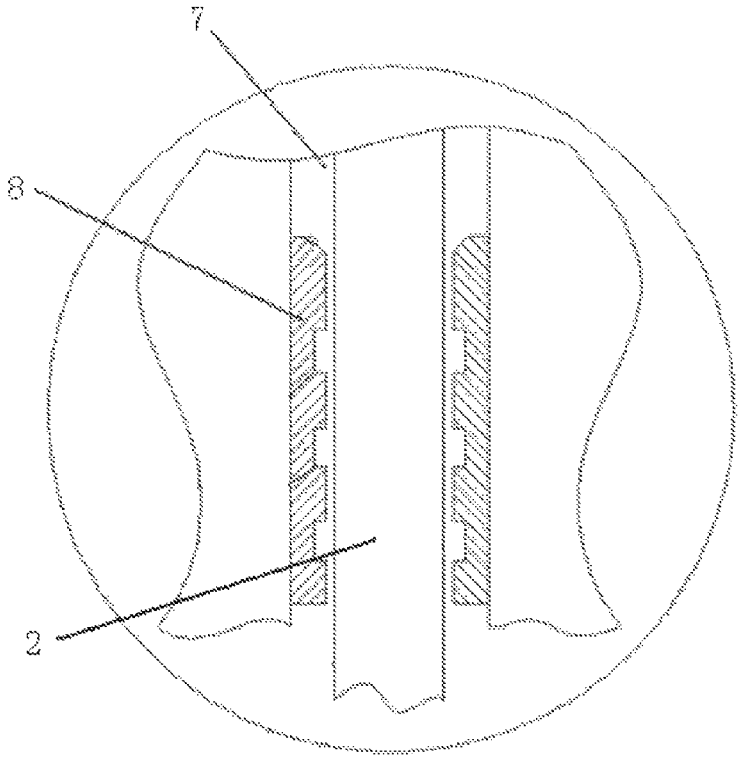
FIG. 3 is an enlarged view of a portion of FIG. 2.

As shown in FIGS. 1-3, each of the four large-cross-section columns 4 are disposed on each of the four corners of the ring buoyancy tank 3 respectively, and the lower parts of these columns are integrally connected to the ring buoyancy tank 3. The large-cross-section columns 4 are cylindrical, square column, prism or cylinder-like case structures, such that the wave drag force applied to the platform can be effectively reduced. Each of the large-cross-section columns 4 is provided with helical strakes 6 on their outside, such that the vortex induced motion of the platform is effectively reduced. Each of the large-cross-section columns 4 is provided with a central pore canal 7 axially, and the lower part of the central pore canal 7 is provided with a chopping board connection structure 8 with a groove.

Figure 4:
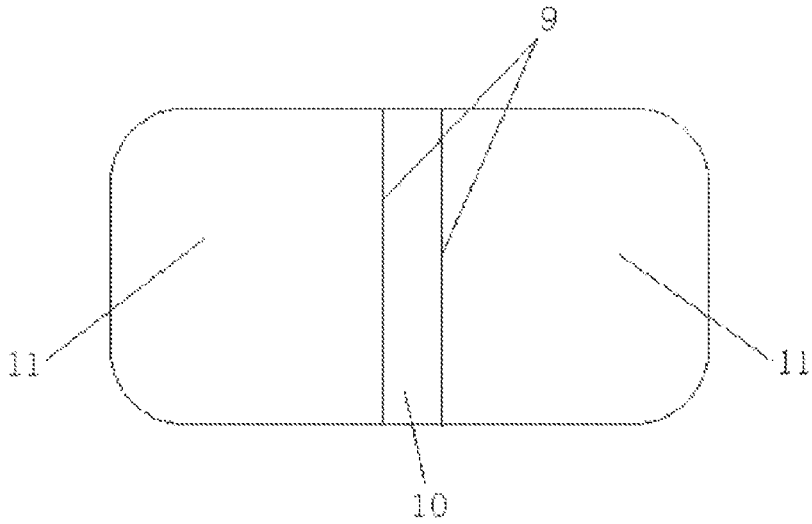
FIG. 4 is a cross sectional view of the structure of the buoyancy tank according to the present invention.

As shown in FIG. 4, the ring buoyancy tank 3 is a large box-shaped structure with rounded corners to reduce the wave drag force. Two longitudinal bulkheads 9 are provided in the ring buoyancy tank 3 to divide its inner space into three parts, so as to provide a structural redundancy after the ring buoyancy tank 3 is damaged, thereby ensuring the security of the platform. A walkway 10 is provided in the space between said two longitudinal bulkheads 9 such that an operator can access the two longitudinal bulkheads for maintenance. The space outside said two longitudinal bulkheads 9 is divided into several watertight compartments 11 to function as fuel/fresh water compartment, equipment compartment, and ballast compartment.

Figure 5:
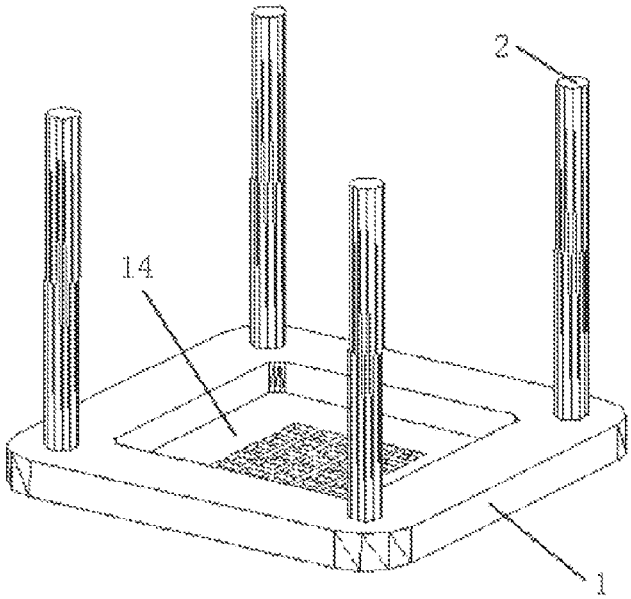
FIG. 5 is a structural illustration of the ring ballast tank of the platform with four columns according to the present invention.

As shown in FIG. 2 and FIG. 5, corresponding to the locations of the large-cross-section columns 4, each of the four small-cross-section columns 2 are disposed on each of the four corners of the ring ballast tank 1 respectively, and the lower parts of these columns are integrally connected to the ring ballast tank 1. When the platform is in its folded state, the small-cross-section columns 2 are inserted into and pass through the central pore canals 7 of the large-cross-section columns 4 correspondingly, and the small-cross-section columns 2 are connected to the large-cross-section columns 4 via wedges, bolts, or pins to form an integrated structure. The small-cross-section columns 2 each is provided with a reverse-cone structure 13 on the top.

The ring ballast tank 1 adopts a permanently fixed ballast mode with the iron ore or other weights filled therein to ensure that the center of buoyancy of the platform is higher than the center of gravity at any condition and that the platform has a deep draft in service, thereby achieving an unconditional stability of the platform in ocean and ensuring the stability and the seakeeping characteristic meeting operating requirements. The ring ballast tank 1 has a heave plate 14 integrated with it in the center at the bottom, and the heave plate 14 have openings in center to allow oil gas production/drilling risers connecting the oil gas processing module/the drilling rig 5 through, with a horizontal support can be provided to the risers.

Figure 6:
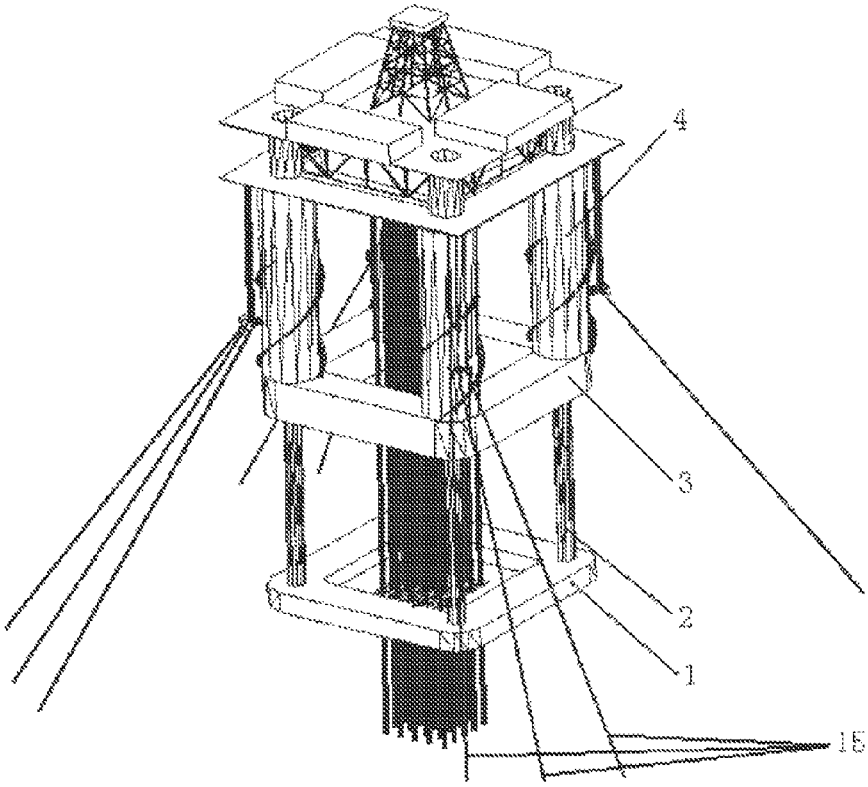
FIG. 6 is an illustration of the platform with four columns according to the present invention, shown in a deployed installation state.

As shown in FIG. 6, the present invention is located via multiple group mooring system. Each of the large-cross-section columns 4 are provided with a group of mooring lines 15, which are connected to the anchor points on the seabed via traditional anchoring means. The mooring lines 15 can employ traditional anchor chains, the combination of anchor chain-wire and rope-anchor chain, or Nylon rope. When the platform needs to move to another place, the mooring lines 15 can be disassembled and the platform is transported to another place, such that the cost is reduced and the economic efficiency is improved.

Figure 7:
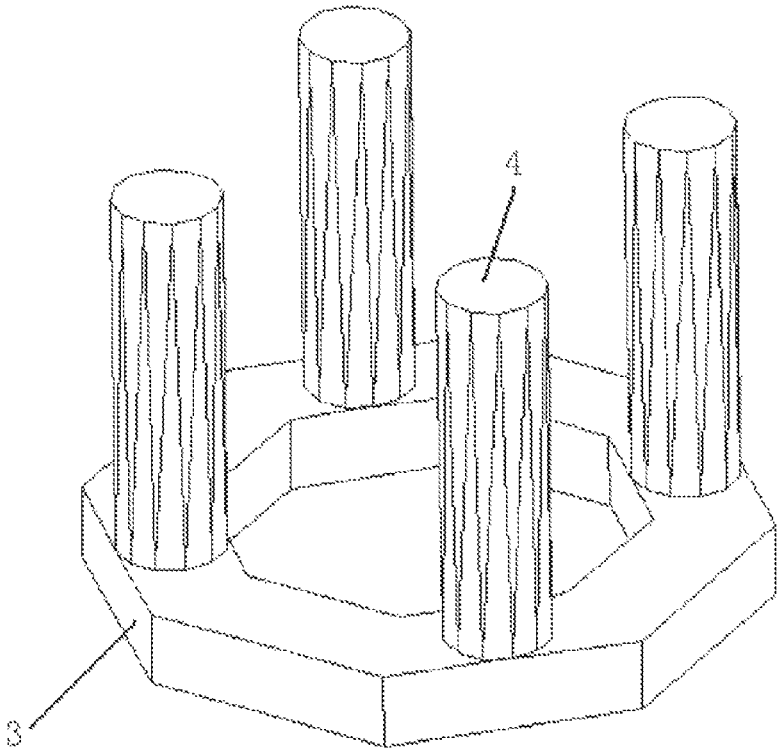
FIG. 7 is a structural illustration of an octagonal ring buoyancy tank of the platform with four columns according to the present invention.
Figure 8:
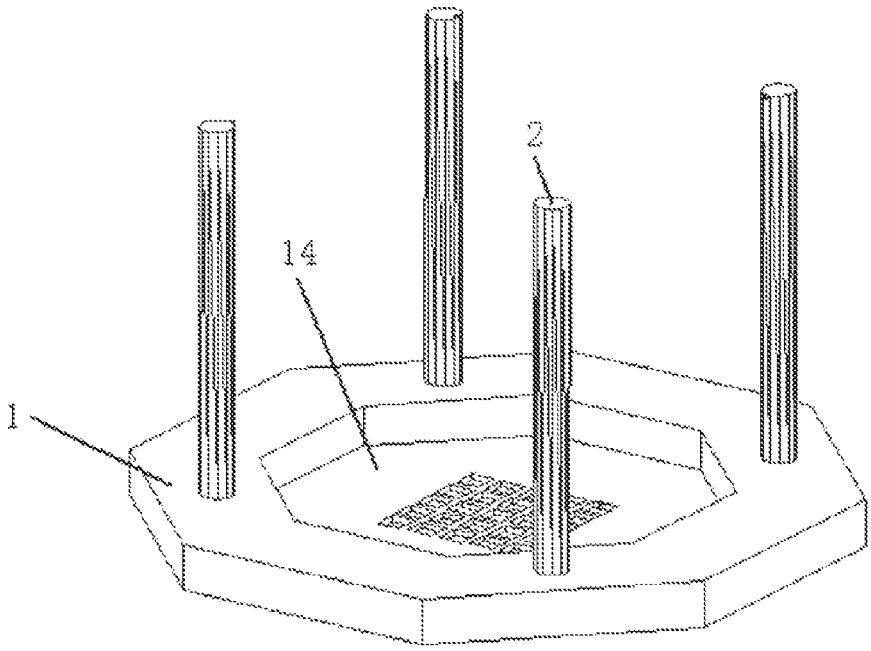
FIG. 8 is a structural illustration of an octagonal ring ballast tank of the platform with four columns according to the present invention.

In the above embodiment, the ring ballast tank 1 and the ring buoyancy tank 3 can also be regular octagonal structures, wherein the small-cross-section columns 2 and the large-cross-section columns 4 are uniformly disposed in the middle on each side of the ring ballast tank 1 and the ring buoyancy tank 3, respectively (shown in FIGS. 7-8). Similarly, the ring ballast tank 1 and the ring buoyancy tank 3 can be regular triangular or hexagonal structures. With the regular triangular structure, there are three small-cross-section columns 2 and three large-cross-section columns 4 which are respectively disposed on the ring ballast tank 1 and the ring buoyancy tank 3, and the small-cross-section columns 2 and the large-cross-section columns 4 are located on the corners of the ring ballast tank 1 and the ring buoyancy tank 3. With the regular hexagonal structure, there are also three small-cross-section columns 2 and three large-cross-section columns 4 which are respectively disposed on the ring ballast tank 1 and the ring buoyancy tank 3, and the small-cross-section columns 2 and the large-cross-section columns 4 are located in the middle on respective sides of the ring ballast tank 1 and the ring buoyancy tank 3. The global structures of the regular triangular, regular hexagonal, and regular octagonal platforms are similar to the square platform, so their description is omitted for the purpose of brevity.

In the above embodiment, compared with installing the upper drilling rig and oil gas processing module 5 offshore, installing the upper drilling rig and oil gas processing module 5 at a platform construction site may reduce the installation cost substantially. Meanwhile, according to the oil field exploitation modes, the upper drilling rig and oil gas processing module 5 could employ conventional drilling rig and oil gas processing facilities, thereby substantially reducing the technical risks of the application of the present invention.

Figure 9:
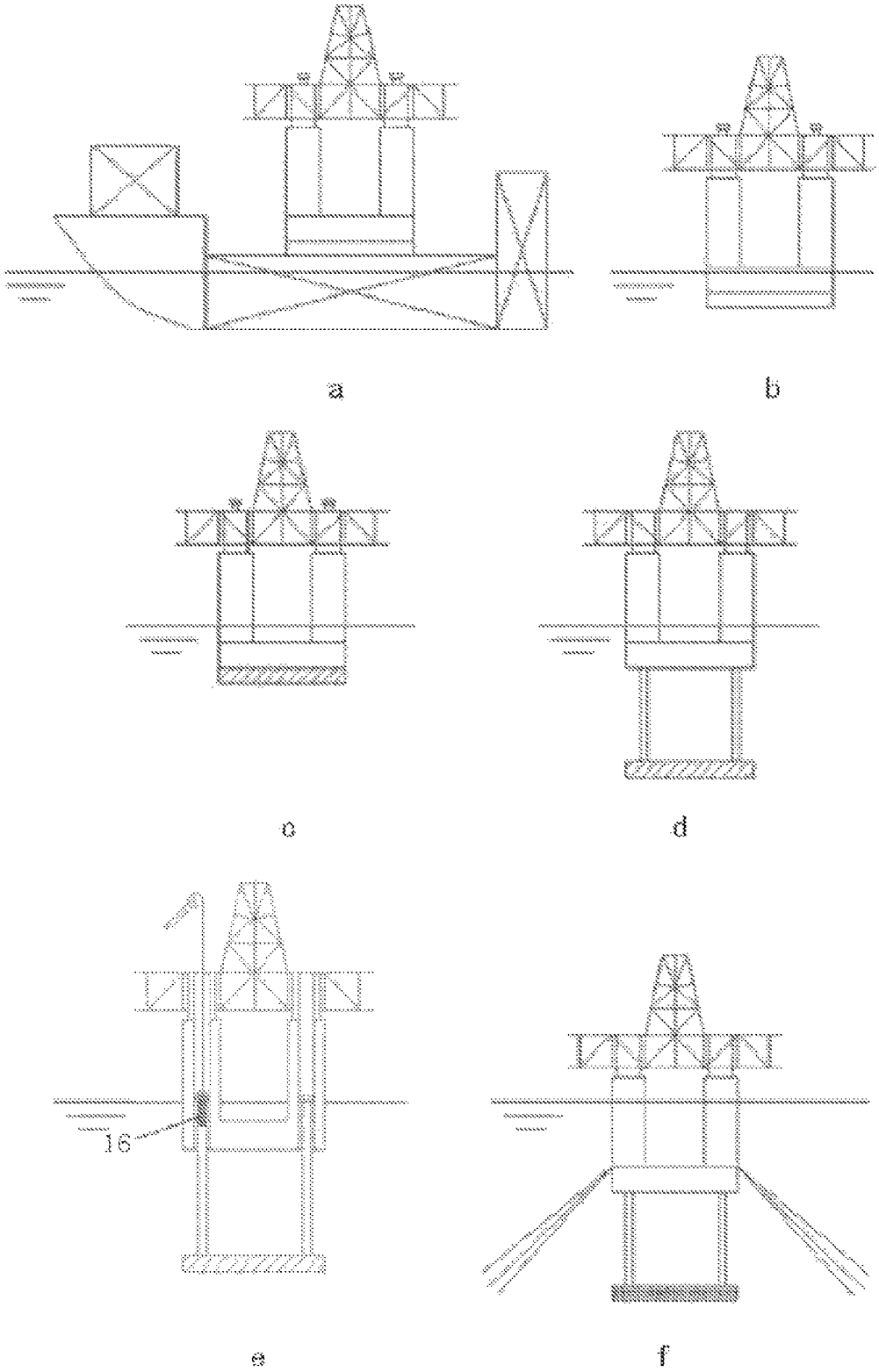
FIGS. 9*a-f* are illustrations of the platform offshore installation according to the present invention during various stages.
Figure 10:
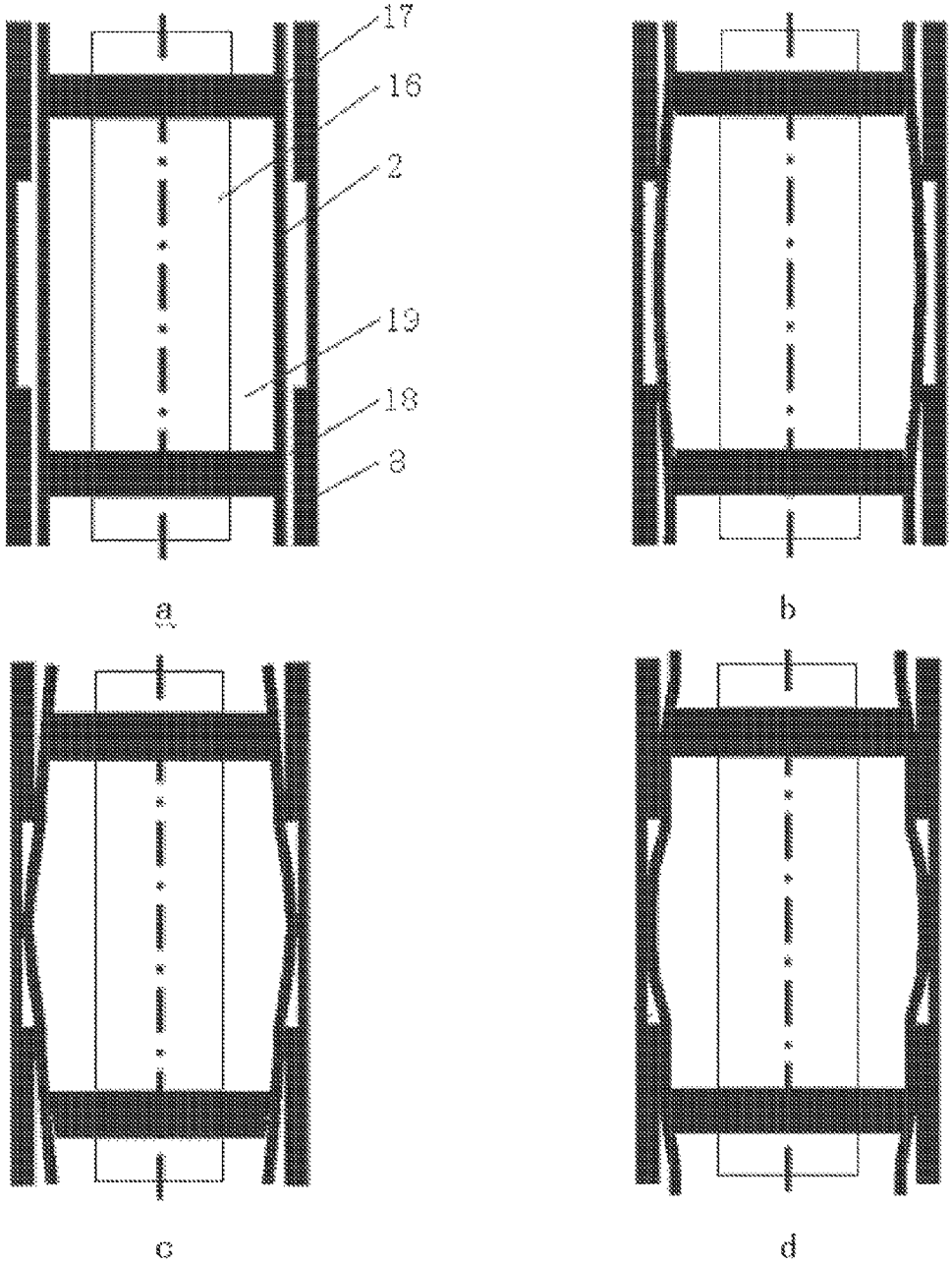
FIGS. 10*a-d* are illustrations showing the sequential processing of the deformation of the hydraulic forging connection according to the present invention.

After the construction is completed at the construction site, the platform of the present invention is in its folded state, with the ring buoyancy tank 3 completely located on the ring ballast tank 1 and the overall height of the platform in its lower state (shown in FIG. 1). The offshore installation method of the present platform includes the steps of:

9. transporting the platform to the installation site via barge dry tow or via self-floating wet tow, offloading it at the installation site, with the platform in a free-floating mode (shown in FIGS. 9*a*-9*b*);

10. partly ballasting the ring ballast tank 1 such that the platform sinks as a whole (shown in FIG. 9*c*);

11. when the overall weight of the ring ballast tank 1, the ballasting water therein, and the small-cross-section columns 2 is more than the buoyancy force of the ring ballast tank 1, the ring ballast tank 1 sinks, the small-cross-section columns 2 gradually go down within the large-cross-section columns 4 in a controlled manner, the ring ballast tank 1 is suspended under the ring buoyancy tank 3 via the reverse-cone structures on the top of the small-cross-section columns 2, and whole platform floats in the water due to the buoyancy force provided by the ring buoyancy tank 3 and the large-cross-section columns 4 (shown in FIGS. 9*d* and 9*e*);

12. passing a hydraulic forging connection apparatus 16 through the central pore canal 7 to the connection between the large-cross-section columns 4 and the small-cross-section columns 2 by using a crane of the platform to enable hydraulic forging, such that the outer panels of the small-cross-section columns 2 at the connection with the large-cross-section columns 4 are plastically deformed by the hydraulic pressure and pressed into the groove of the chopping board connection structure 8 at the connection of the lower part of the large-cross-section columns 4, to join these two structures into an integrated structure (shown in FIG. 9*e*), wherein the deformation process of the hydraulic forging connection includes four stages:

Stage A (initial stage): locating the hydraulic forging connection apparatus 16 into a connection position, such that the upper and lower sealing rings 17, and 18 of the hydraulic forging connection apparatus 16 seal corresponding connection positions of the small-cross-section column 2 to form a sealed space 19, and the sealed space 19 is filled with hydraulic fluid with a high pressure to deform the outer panel of the small-cross-section column 2 (shown in FIG. 10*a*);

Stage B: increasing the hydraulic pressure to make the outer panel of the small-cross-section column 2 plastically deformed such that the outer panel of the small-cross-section column contacts the convex ridges of the groove of the chopping board connection structure 8 (shown in FIG. 10*b*);

Stage C: increasing the hydraulic pressure to make the outer panel of the small-cross-section column 2 further plastically deformed such that outer panel of the small-cross-section column 2 contacts the bottom of the groove of the chopping board connection structure 8 (shown in FIG. 10*c*); and Stage D: increasing the hydraulic pressure to make the outer panel of the small-cross-section column 2 further plastically deformed such that the outer panel of the small-cross-section column 2 completely tightly contacts the chopping board connection structure 8 at the lower part of the large-cross-section column 4 to form a unity, except the corners at the bottom of the groove (shown in FIG. 10*d*).

5. after the connection between the small-cross-section columns 2 and the large-cross-section columns 4 is completed, an ultrasonic inspection is applied to check the installation quality of the connection, and if the inspection is passed, ballasting the ring ballast tank to the preset value, and installing the mooring system and riser system to complete all of the installation operations of the platform (shown in FIG. 10*f*).

The present invention is described only by providing the above embodiments. Various modifications may be made to the structures, positions, and connections of various components. On the basis of the technical solutions of the present invention, any modification and equivalent change to individual components according to the spirit of the present invention, should not be excluded from the scope protected by the present invention.

The invention claimed is:

1. An integrative deep draft floating production platform with unconditional stability, comprising:

a ring ballast tank at a bottom, small-cross-section columns on the ring ballast tank, a middle ring buoyancy tank with a same or a similar shape as the ring ballast tank, large-cross-section columns with a same number as the small-cross-section columns and located on the middle ring buoyancy tank, and a drilling rig and an oil gas processing module on a top of the large-cross-section columns; wherein the ring ballast tank adopts a permanently fixed ballast, and the ring ballast tank is internally filled with weights to ensure that a center of buoyancy of the integrative deep draft floating production platform is higher than a center of gravity; wherein the large-cross-section columns are uniformly arranged on the middle ring buoyancy tank and lower parts thereof are integrated with the middle ring buoyancy tank; each of the large-cross-section column is provided with a central pore canal axially, wherein a lower part in the central pore canal is provided with a chopping board connection structure with a groove;

corresponding to the large-cross-section columns, the small-cross-section columns are uniformly arranged on the ring ballast tank and lower parts thereof are integrated with the ring ballast tank; the small-cross-section columns insertable into and through the central pore canal of the large-cross-section columns correspondingly after a construction of the integrative deep draft floating production platform is completed, and the small-cross-section columns are integrated with the large-cross-section columns via wedges, bolts, or pins while the integrative deep draft floating production platform is in a folded state; each of the small-cross-section columns provided with a reverse-cone structure on a top;

each of the large-cross-section columns provided with a group of mooring lines which are connected to an anchor on a seabed via a mooring device; and the drilling rig and the oil gas processing module are installed at a construction site, and the integrative deep draft floating production platform is transportable to an installation site by a dry tow or a wet tow as a whole to then be installed.

2. The integrative deep draft floating production platform with unconditional stability according to claim 1, wherein the ring ballast tank is a regular polygon structure with a heave plate integrated with it in a center at a bottom, wherein the heave plate has openings in the center through which oil and gas production risers/drilling risers connects to the oil gas processing module/the drilling rig.

3. The integrative deep draft floating production platform with unconditional stability according to claim 1, wherein the middle ring buoyancy tank has a large box-shaped structure with rounded corners, and two longitudinal bulkheads are provided in the middle ring buoyancy tank to divide an inner space of the buoyancy tank structure into three parts, wherein a walkway is provided in a space between the two longitudinal bulkheads, and a space outside the two longitudinal bulkheads is divided into several watertight compartments.

4. The integrative deep draft floating production platform with unconditional stability according to claim 2, the middle ring buoyancy tank has the large box-shaped structure with the rounded corners, and the two longitudinal bulkheads are provided in the middle ring buoyancy tank to divide the inner space of the buoyancy tank structure into three parts, wherein a walkway is provided in the space between said two longitudinal bulkheads, and the space outside the two longitudinal bulkheads is divided into several watertight compartments.

5. The integrative deep draft floating production platform with unconditional stability according to claim 1, wherein the large-cross-section columns are cylindrical, square column, prism or cylinder-like case structures, and each of the large-cross-section columns is provided with helical strakes outside of the large-cross-section columns.

6. The integrative deep draft floating production platform with unconditional stability according to claim 1, wherein the mooring lines are traditional anchor chains, a combination of anchor chain-wire and rope-anchor chain, or Nylon rope.

7. The integrative deep draft floating production platform with unconditional stability according to claim 5, wherein the mooring lines are the traditional anchor chains, the combination of anchor chain-wire and rope-anchor chain, or the Nylon rope.

8. An offshore installation method of an integrative deep draft floating production platform with unconditional stability comprising:

transporting the integrative deep draft floating production platform to an installation site via a barge dry tow or via a self-floating wet tow;

offloading it at the installation site, with the integrative deep draft floating production platform in a free-floating mode;

ballasting a ring ballast tank such that the integrative deep draft floating production platform sinks as a whole when the weights of the ring ballast tank, ballasting water, and small-cross-section columns are greater than a buoyancy force, making the small-cross-section columns gradually down within large-cross-section columns in a controlled manner, wherein the ring ballast tank is suspended under a ring buoyancy tank via a reverse-cone structure on the top of the small-cross-section columns, and the integrative deep draft floating production platform floats in water due to the buoyancy force provided by the ring buoyancy tank and the large-cross-section columns;

passing a hydraulic forging connection apparatus through a central pore canal to a connection between the large-cross-section columns and the small-cross-section columns by using a crane of the integrative deep draft floating production platform to enable the hydraulic forging connection apparatus to plastically deform the outer panel of the small-cross-section columns at the connection with the large-cross-section columns by a hydraulic pressure and pressing it into a groove of a chopping board connection structure at a connection of a lower part of the large-cross-section columns, to join the large-cross-section columns and the small cross-section-columns into an integrated structure; and after connecting the large-cross-section columns and the small-cross-section columns, applying an ultrasonic inspection to check an installation quality of the connection, and if the ultrasonic inspection is passed, ballasting the ring ballast tank to a preset value, and installing a mooring system and a riser system to complete installation operations of the integrative deep draft floating production platform.

9. The method of claim 8 wherein the hydraulic forging connection apparatus is located in a connection position, such that an upper and a lower sealing rings of the hydraulic forging connection apparatus seal corresponding connection positions of the small-cross-section columns to form a sealed space, and the sealed space is filled with hydraulic fluid with a high pressure to deform an outer panel of the small-cross-section columns.

10. The method of claim 8 further comprising increasing the hydraulic pressure to make the outer panel of the small-cross-section columns plastically deformed such that the outer panel of the small-cross-section columns contacts convex ridges of the groove of the chopping board connection structure.

11. The method of claim 8 further comprising increasing the hydraulic pressure to make the outer panel of the small-cross-section columns further plastically deformed such that outer panel of the small-cross-section columns contacts a bottom of the groove of the chopping board connection structure.

12. The method of claim 8 further comprising increasing the hydraulic pressure to make the outer panel of the small-cross-section column further plastically deformed such that the outer panel of the small-cross-section column completely tightly contacts the chopping board connection structure at a lower part of the large-cross-section columns to form a unity, except at corners at the bottom of the groove.

* * * * *